US008485948B2

(12) United States Patent
Cen

(10) Patent No.: US 8,485,948 B2
(45) Date of Patent: Jul. 16, 2013

(54) FITNESS EQUIPMENT

(75) Inventor: Jianli Cen, Zhejiang (CN)

(73) Assignee: Ningbo Wowei Dynamics Industry Technique Co., Ltd., Yuyao (CN)

( * ) Notice: Subject to any disclaimer, the term of this patent is extended or adjusted under 35 U.S.C. 154(b) by 0 days.

(21) Appl. No.: 13/322,456

(22) PCT Filed: Apr. 27, 2011

(86) PCT No.: PCT/CN2011/073400

§ 371 (c)(1),
(2), (4) Date: Jan. 11, 2012

(87) PCT Pub. No.: WO2012/010001

PCT Pub. Date: Jan. 26, 2012

(65) Prior Publication Data

US 2012/0115688 A1 May 10, 2012

(30) Foreign Application Priority Data

Jul. 19, 2010 (CN) ..... 2010 2 0264692 U

(51) Int. Cl.
*A63B 21/072* (2006.01)
*A63B 21/00* (2006.01)
*A63B 21/06* (2006.01)

(52) U.S. Cl.
USPC ..... 482/108; 482/92; 482/93

(58) Field of Classification Search
USPC ..... 482/44, 45, 46, 49, 50, 93, 108, 106, 482/109; D21/662, 679, 680, 684, 686, 694
See application file for complete search history.

(56) References Cited

U.S. PATENT DOCUMENTS

| | | | | | |
|---|---|---|---|---|---|
| 3,311,374 | A * | 3/1967 | Wittenberg et al. | ..... | 482/106 |
| D274,283 | S * | 6/1984 | Wright | ..... | D21/682 |
| 4,773,640 | A * | 9/1988 | Kolbel et al. | ..... | 482/108 |
| 4,822,035 | A * | 4/1989 | Jennings et al. | ..... | 482/106 |
| 4,854,575 | A | 8/1989 | Wilson et al. | | |
| 5,184,993 | A * | 2/1993 | Dowdeswell | ..... | 482/106 |
| 5,250,014 | A * | 10/1993 | Chang | ..... | 482/106 |
| 6,450,928 | B1 * | 9/2002 | Larkins, Jr. | ..... | 482/110 |
| 7,878,952 | B2 * | 2/2011 | Fenelon | ..... | 482/93 |
| 2003/0207740 | A1 * | 11/2003 | Fenelon et al. | ..... | 482/107 |

(Continued)

FOREIGN PATENT DOCUMENTS

| | | | |
|---|---|---|---|
| CN | 2920314 | Y | 7/2007 |
| CN | 2936320 | Y | 8/2007 |
| CN | 201719747 | U | 1/2011 |
| JP | 8000165 | A | 1/1996 |

*Primary Examiner* — Loan Thanh
*Assistant Examiner* — Sundhara Ganesan
(74) *Attorney, Agent, or Firm* — Enshan Hong; Kent H. Cheng; VLP Law Group LLP

(57) ABSTRACT

The invention discloses a fitness equipment which comprises a ring-shaped gravity body and a handle connected with the gravity body, wherein, the handle is positioned in the radial position of the interior of the ring-shaped gravity body, the end parts of the handle are detachably and fixedly connected with the gravity body, protective covers are embedded into the inner surface of the ring-shaped gravity body, and through the coverage of the protective covers, the connecting parts between the ring-shaped gravity body and the handle are rendered smooth. Through the application of the protective covers and the appropriate structural design of the two end parts of the handle, the surfaces of the fitness equipment provided by the invention can be rendered smooth, thereby effectively avoiding injuries to users.

9 Claims, 3 Drawing Sheets

U.S. PATENT DOCUMENTS

2005/0096200 A1* 5/2005 Amann ..... 482/110
2005/0187079 A1* 8/2005 Diakonov et al. ..... 482/106
2005/0227831 A1* 10/2005 Mills et al. ..... 482/106
2006/0073951 A1 4/2006 Walkow et al.
2008/0176723 A1* 7/2008 Johnson ..... 482/106
2009/0075792 A1* 3/2009 Stugart ..... 482/93

* cited by examiner

FITNESS EQUIPMENT

PRIORITY CLAIM

This is a U.S. national stage of application No. PCT/CN2011/073400, filed on Apr. 27, 2011. Priority is claimed on the following application: CN Application No.: 201020264692 Filed on Jul. 19, 2010, the contents of which are incorporated here by reference.

TECHNICAL FIELD

The invention relates to fitness equipment, in particular fitness equipment with a ring-shaped gravity body.

BACKGROUND ART

Among the currently available domestic fitness devices, the fitness equipment with a ring-shaped gravity body becomes increasingly popular, which comprises the ring-shaped gravity body and a handle movably connected with the ring-shaped gravity body, wherein, square handle installation grooves are formed oppositely on the inner ring surface of the gravity body, handle key surfaces matched with the handle installation grooves are respectively formed through cutting on the side surfaces at two ends of the handle, and screw holes are formed on two end surfaces of the handle. After the handle is placed in the installation position through the installation grooves, bolts can be fixedly connected with the ring-shaped gravity body through the screw holes formed on the outer surface of the ring-shaped gravity body.

The defect of the structure lies in that the handle installation grooves affect the integrity of the inner surface of the ring-shaped gravity body, so that the fitness equipment can easily inflict skin injuries on a user.

CONTENTS OF THE INVENTION

The invention is designed to overcome the defect in the prior art. Through the applying of protective covers and the appropriate structural design of the two end parts of a handle, the surfaces of the fitness equipment can be rendered smooth, thereby effectively avoiding injuries to users.

Fitness equipment provided by the invention comprises a ring-shaped gravity body and a handle connected with the gravity body, wherein, the handle is positioned in the radial position of the interior of the ring-shaped gravity body, the end parts of the handle are detachably and fixedly connected with the gravity body, protective covers are embedded into the inner surface of the ring-shaped gravity body, and through the coverage of the protective covers, the connecting parts between the ring-shaped gravity body and the handle are rendered smooth.

Wherein, the end parts of the handle are detachably and fixedly connected with the gravity body in the following manner: a fastening screw hole is formed axially on one end surface of the handle, a stepped through hole corresponding to the handle fastening screw hole is formed between the inner and outer surfaces of the ring-shaped gravity body, the large end diameter part of the stepped through hole is positioned on the outer surface of the ring-shaped gravity body, a stepped sleeve matched in shape with the stepped through hole is arranged in the stepped through hole, a bolt through hole is formed axially in the stepped sleeve, a bolt passes through the bolt through hole in the sleeve to be in threaded connection with the handle fastening screw hole so that the handle is fixedly connected with the ring-shaped gravity body, and the outer end port of the through hole of the ring-shaped gravity body is covered by an end cover.

Wherein, a right-angle cut 82 is formed circumferentially on the end surface of the handle, a counter bore is formed axially on the inner side end surface of the sleeve, and the inside diameter of the counter bore is matched with the diameter of a columnar surface formed by the right-angle cut 82, so that the inner wall of the counter bore is in sleeved connection with the columnar surface and the inner side end surface of the sleeve is propped against the radial end surface of the right-angle cut 82 of the handle.

Wherein, a cut 71 is formed between the inner and outer surfaces of the counter bore on the end surface of the sleeve, and a lug which corresponds to the right-angle cut 82 in position is formed on the handle, when the sleeve is in sleeved connection with the handle, the lug is embedded into the cut 71 for the fixation of the handle and the sleeve.

Wherein, the protective covers comprise a first protective cover and a second protective cover which are both ring-shaped, the inner ring surfaces of the protective covers are smooth, the outer ring surfaces of the protective covers are matched with the inner surface of the ring-shaped gravity body, the first protective cover and the second protective cover are butted from two sides along the axis of the ring-shaped gravity body, the first and the second protective covers are fixedly connected with each other through a butting connection mechanism and cover the inner surface of the ring-shaped gravity body, the first and the second protective covers are respectively provided with semi-circular enclosure parts which are matched with the handle in shape, have the same axial direction as the handle and are arranged in handle installation positions, convex ribs are arranged on the axial end surfaces of the enclosure parts and extend inwards in the radial direction of the handle, a ring-shaped groove which correspond to the convex ribs in position are correspondingly formed on the handle, the convex ribs are matched with the ring-shaped groove of the handle and are embedded into the groove, and after embedding, the enclosure parts enable the handle to be smoothly connected with the protective covers.

Wherein, the butting connection mechanism between the first and the second protective covers is designed in the following manner: retaining rings are arranged circumferentially on the end surface of the second protective cover, hasp plates are arranged equidistantly in the circumferential direction on the first protective cover, the hasp plates extend axially and are elastic in the radial direction, hasp heads are arranged on the inner sides at the free ends of the hasp plates and extend out of the inner side surfaces of the hasp plates, and inclined guide surfaces are arranged at the upper parts of the hasp heads, when the first and the second protective covers are buckled with each other, the hasp plates are subject to outward radial elastic deformation after the guide surfaces of the hasp heads are propped against the end surfaces of the retaining rings, and the hasp heads start to cross the end surfaces of the retaining rings; and the hasp plates rebound under the action of an elastic restoring force after the hasp heads cross the retaining rings, and the hasp heads are clamped with the retaining rings, so that the fixed connection between the protective covers is completed.

Wherein, concave parts, which correspond in position to the hasp plates, are formed on the inner surface of the ring-shaped gravity body, the hasp plates are matched in width and thickness with the concave parts, and the hasp plates are embedded into the concave parts after the first and the second protective covers are buckled with each other.

Wherein, a protective sleeve made of rubber is in sleeved connection with the outer surface of the ring-shaped gravity body, a decorative ring is in sleeved connection with the outer surface of the protective sleeve, and the outer surface of the handle is coated with an anti-skid layer made of rubber.

Compared with the prior art, since the inner surface of the ring-shaped gravity body and the connecting part between the ring-shaped gravity body and the handle are covered by the protective covers, the surfaces of the fitness equipment provided by the invention are smooth and flat, so that the fitness equipment can be prevented from injuring the skin of a user when in use.

MEANINGS OF THE MARKS ON ATTACHED FIGURES

1—Outer decorative ring of the ring-shaped gravity body;

2—Protective sleeve of the ring-shaped gravity body;

3—First protective cover; 31—Hasp plates of the first protective cover; 32—Hasp heads of the hasp plates; 33—First protective cover enclosure part, 34—Convex ribs of the first protective cover;

4—Ring-shaped gravity body; 41—Stepped through hole on the ring-shaped gravity body;

5—Fastening bolt;

6—Gasket;

7—Sleeve; 71—Sleeve cut; 72—Bolt through hole of the sleeve; 73—Counter bore of the sleeve;

8—Handle; 81—Ring-shaped groove of the handle; 82—Right-angle cut of the handle; 83—Lug of the handle; 84—Handle fastening screw hole;

9—Second protective cover; 91—Retaining rings of the second protective cover; 92—Second protective cover enclosure part; 93—Convex ribs of the second protective cover;

10—Anti-skid layer of the handle;

110—End cover for the outer end port of the through hole of the ring-shaped gravity body.

MODE OF CARRYING OUT THE INVENTION

Below is the detailed description of a specific method of implementing of the invention with reference to the attached figures. Note that the protective scope of the invention is not limited to this specific method.

Figure 1:
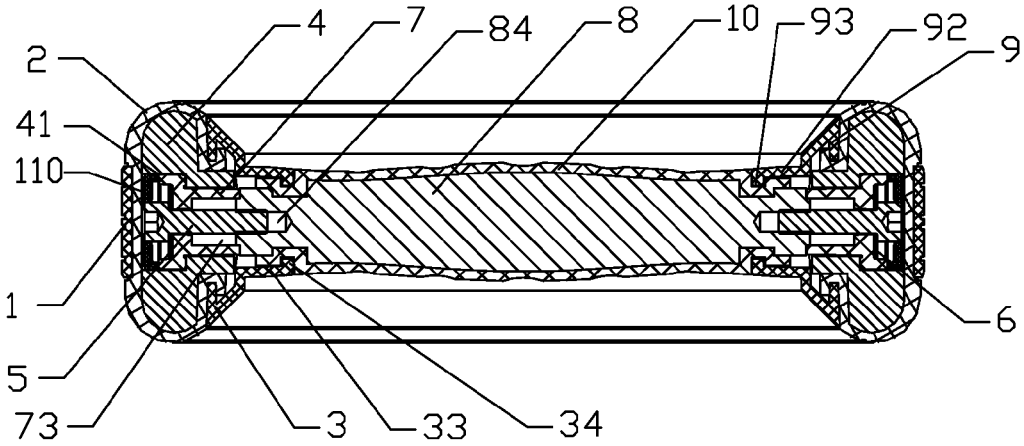
FIG. 1 is the sectional view of the handle of the fitness equipment provided by the invention.
Figure 2:
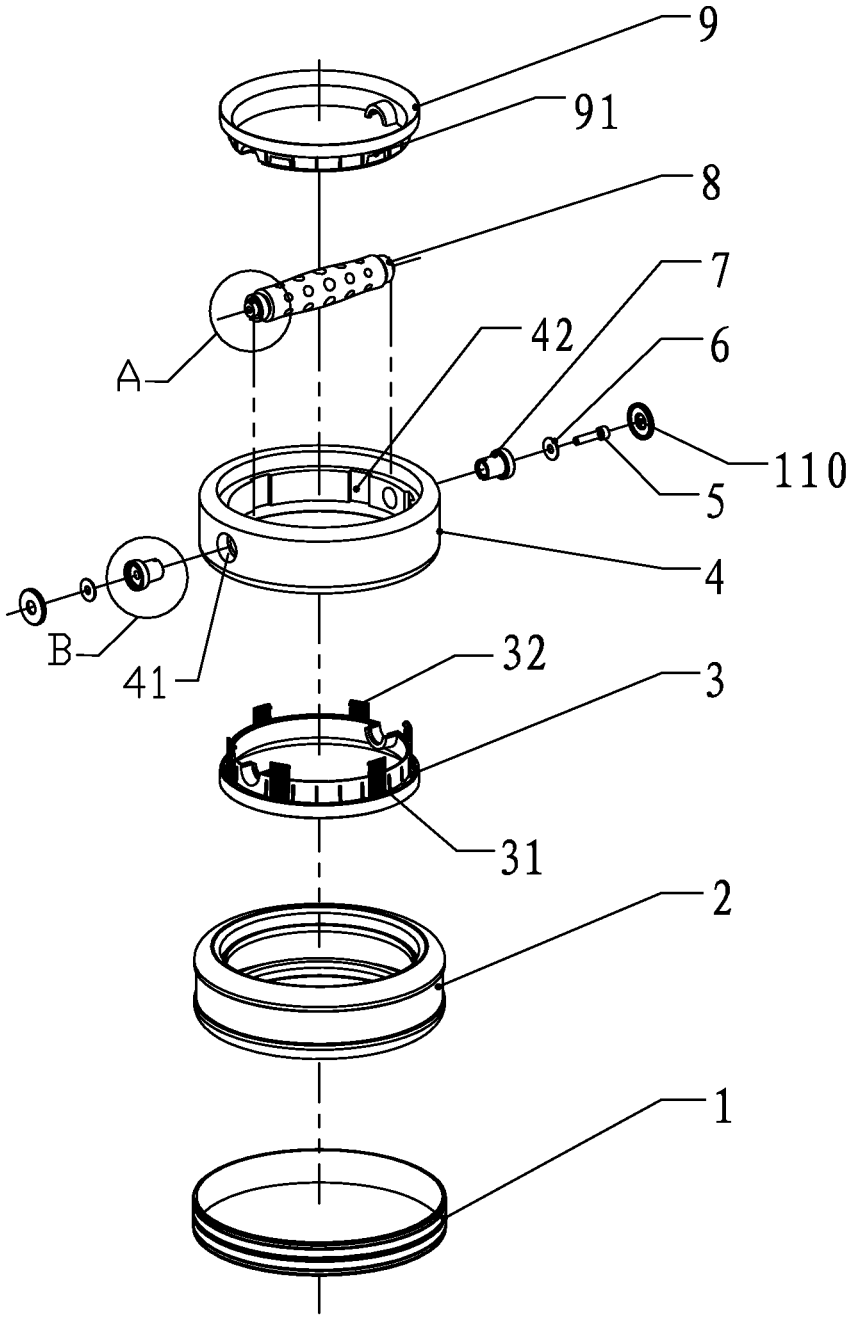
FIG. 2 is the schematic diagram of the fitness equipment provided by the invention.
Figure 3:
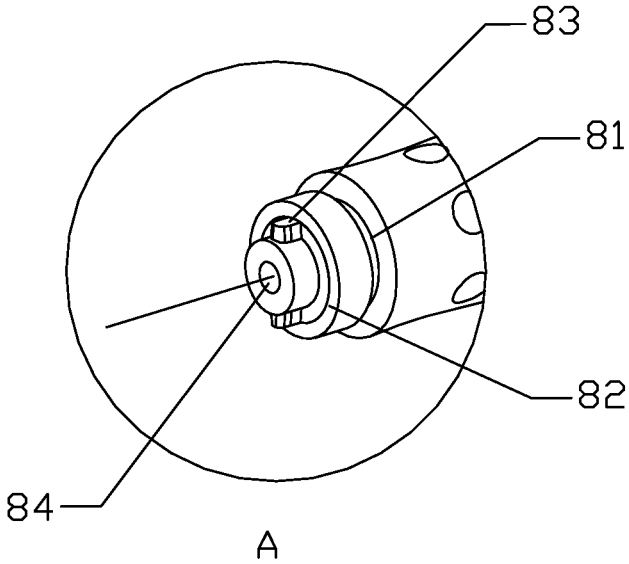
FIG. 3 is the partial enlarged drawing of Part A in FIG. 2.
Figure 4:
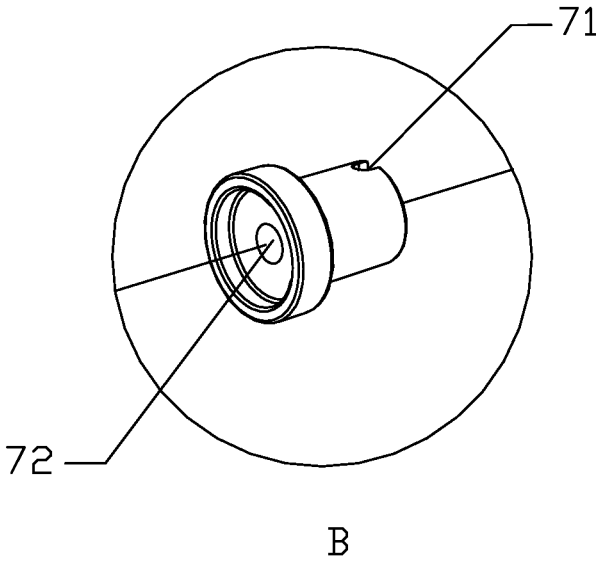
FIG. 4 is the partial enlarged drawing of Part B in FIG. 2.

As shown in FIGS. 1 and 2, the invention provides fitness equipment provided with a ring-shaped gravity body 4 and a handle 8, wherein, the handle 8 is positioned in the radial position of the interior of the ring-shaped gravity body 4, the two ends of the handle 8 are fixedly connected with the gravity body 4 through detachable connecting mechanisms, a first protective cover 3 and a second protective cover 9 are embedded into the inner surface of the ring-shaped gravity body 4, and through the coverage of the two protective covers, the connecting parts between the ring-shaped gravity body and the handle and the inner surface of the ring-shaped gravity body are rendered smooth so that the fitness equipment can be prevented from injuring the skin of a user when in use.

Furthermore, as shown in FIGS. 1-4, the detachable connecting mechanism for connecting the handle 8 and the gravity body 4 is characterized in that a fastening screw hole 84 with a certain depth is formed axially on one end surface of the handle, a stepped through hole 41 corresponding to the handle fastening screw hole 84 is formed between the inner and outer surfaces of the ring-shaped gravity body 4, the large end diameter part of the through hole 41 is positioned on the outer surface of the gravity body, a stepped sleeve 7 matched in shape with the through hole is arranged in the through hole 41, a bolt through hole 72 is formed axially in the sleeve 7, a right-angle cut 82 with right-angle sides is formed circumferentially through cutting in the position of the end part of the handle 8, a right-shaped groove 81 parallel to the cut 82 is formed on the handle close to the ring-angle cut 82, a counter bore 73 with a certain depth is formed axially on the abutting end surface between the inner side of the sleeve 7 and the handle, the inside diameter of the counter bore is matched with the diameter of a column formed by the right-angle cut 82 of the handle, the column is sleeved in the counter bore, the inner side end surface of the sleeve 7 is propped against the radial end surface of the right-angle cut 82 of the handle, a cut 71 with certain width and length is formed between the inner and outer surfaces of the counter bore 73 on the end surface of the sleeve 7, and a lug 83 which corresponds to the right-angle cut 82 in position is formed on the handle. When the sleeve 7 is sleeved into the handle 8, the lug 83 is embedded into the cut 71 of the sleeve for the fixation of the handle and the sleeve, and a bolt 5 passes through a gasket 6 and the sleeve 7 to be in threaded connection with the handle fastening screw hole 84, so that the handle 8 is fixedly connected with the ring-shaped gravity body 4. The outer end port of the through hole 41 of the ring-shaped gravity body is covered by an end cover 110 whose shape is matched with that of the outer end port.

Furthermore, as shown in FIGS. 1-2, a protective cover is ring-shaped and comprises the first protective cover 3 and the second protective cover 9, the inner surfaces of the protective covers are smooth, the outer surfaces of the protective covers are matched with the inner surface of the ring-shaped gravity body 4 of the fitness equipment, the outer surface of the first protective cover and the outer surface of the second protective cover are butted from two sides along the axis of the ring-shaped gravity body 4 respectively, the two protective covers are fixedly connected with each other through the butting connection mechanism after being butted and cover the inner surface of the ring-shaped gravity body 4, the protective covers are respectively provided with semi-circular enclosure parts, that is, a first protective cover enclosure part 33 and a second protective cover enclosure part 92, which are matched with the handle in shape, have the same axial direction as the handle and are arranged in handle installation positions, convex ribs, that is, a first protective cover convex rib 34 and a second protective cover convex rib 93, are arranged on the axial end surfaces of the enclosure parts, the convex ribs extend inwards in the radial direction of the handle, the convex ribs are matched with the ring-shaped grooves 81 of the handle and are embedded into the ring-shaped grooves 81, and the enclosure parts enable the handle to be smoothly connected with the protective covers.

Furthermore, as shown in FIGS. 1-2, the connection mechanism between the protective covers is a hasp mechanism, wherein, retaining rings 91 are arranged circumferentially on the end surface of the second protective cover 9, hasp plates 31 with certain width and thickness are arranged equidistantly in the circumferential direction on the first protective cover 3, the hasp plates 31 extend axially and are elastic in the radial direction, hasp heads 32 are arranged at the free ends of the hasp plates 31 and extend inwards to protrude from the inner surfaces of the hasp plates 31, and inclined guide surfaces are arranged at the upper parts of the hasp heads 32. When the two protective covers are buckled with each other, the hasp plates 31 are subject to radial elastic deformation after the guide surfaces of the hasp heads are propped against the end surfaces of the retaining rings 91, and the hasp heads start to cross the end surfaces of the retaining rings 91; and the hasp plates rebound under the action of an elastic restoring force after the hasp heads 32 cross the retaining rings 91, and the hasp heads 32 are clamped with the retaining rings 91, so that the fixed connection between the protective covers is completed. Concave parts (not shown in the figures), which correspond in position to the hasp plates 31, are formed on the inner surface of the ring-shaped gravity body 4, the hasp plates 31 are matched in width and thickness with the concave parts, and the hasp plates 31 are embedded into the concave parts after the first protective cover and the second protective cover are buckled with each other.

As shown in FIGS. 1-2, a protective sleeve 2 made of rubber is in sleeved connection with the outer surface of the ring-shaped gravity body 4, a decorative ring 1 is in sleeved connection with the outer surface of the protective sleeve 2, and the outer surface of the handle 8 is coated with an anti-skid layer 10 made of rubber.

Since the inner surface of the ring-shaped gravity body and the connecting part between the ring-shaped gravity body and the handle are covered by the protective covers, the surfaces of the fitness equipment provided by the invention are smooth and flat, so that the fitness equipment can be prevented from injuring the skin of a user when in use.

The invention is not limited to the above disclosed fitness equipment, which is only a specific embodiment of the invention. Any changes that the technicians in this field can conjure up should fall into the protective scope of the invention.

The invention claimed is:

1. A fitness equipment comprising a ring-shaped gravity body and a handle connected with the gravity body, wherein, the handle is positioned in the radial position of the interior of the ring-shaped gravity body, the end parts of the handle are detachably and fixedly connected with the gravity body, protective covers are embedded into the inner surface of the ring-shaped gravity body, and through the coverage of the protective covers, the connecting parts between the ring-shaped gravity body and the handle are rendered smooth, and the end parts of the handle are detachable and fixedly connected with the gravity body in the following manner;

a fastening screw hole is formed axially on one end surface of the handle, a stepped through hole corresponding to the handle fastening screw hole is formed between the inner and outer surfaces of the ring-shaped gravity body, the large end diameter part of the stepped through hole is positioned on the outer surface of the ring-shaped gravity body, a stepped sleeve matched in shape with the stepped through hole is arranged in the stepped through hole, a bolt through hole is formed axially in the stepped sleeve, a bolt passes through the bolt through hole in the sleeve to be in threaded connection with the handle fastening screw hole so that the handle is fixedly connected with the ring-shaped gravity body, and the outer end port of the through hole of the ring-shaped gravity body is covered by an end cover.

2. The fitness equipment, according to claim 1, wherein a right-angle cut is formed circumferentially on the end surface of the handle, a counter bore is formed axially on the inner side end surface of the sleeve, and the inside diameter of the counter bore is matched with the diameter of a columnar surface formed by the right-angle cut, so that the inner wall of the counter bore is in sleeved connection with the columnar surface and the inner side end surface of the sleeve is propped against the radial end surface of the right-angle cut of the handle.

3. The fitness equipment, according to claim 2, wherein a cut is formed between the inner and outer surfaces of the counter bore on the end surface of the sleeve, and a lug which corresponds to the right-angle cut in position is formed on the handle, when the sleeve is in sleeved connection with the handle, the lug is embedded into the cut for the fixation of the handle and the sleeve.

4. The fitness equipment, according to claim 1, wherein the protective covers comprise a first protective cover and a second protective cover which are both ring-shaped, the inner ring surfaces of the protective covers are smooth, the outer ring surfaces of the protective covers are matched with the inner surface of the ring-shaped gravity body, the first protective cover and the second protective cover are butted from two sides along the axis of the ring-shaped gravity body, the first and the second protective covers are fixedly connected with each other through a butting connection mechanism and cover the inner surface of the ring-shaped gravity body, the first and the second protective covers are respectively provided with semi-circular enclosure parts which are matched with the handle in shape, have the same axial direction as the handle and are arranged in handle installation positions, convex ribs are arranged on the axial end surfaces of the enclosure parts and extend inwards in the radial direction of the handle, a ring-shaped groove which correspond to the convex ribs in position are correspondingly formed on the handle, the convex ribs are matched with the ring-shaped groove of the handle and are embedded into the groove, and after embedding, the enclosure parts enable the handle to be smoothly connected with the protective covers.

5. The fitness equipment, according to claim 4, wherein the butting connection mechanism between the first and the second protective covers is designed in the following manner: retaining rings are arranged circumferentially on the end surface of the second protective cover, hasp plates are arranged equidistantly in the circumferential direction on the first protective cover, the hasp plates extend axially and are elastic in the radial direction, hasp heads are arranged on the inner sides at the free ends of the hasp plates and extend out of the inner side surfaces of the hasp plates, and inclined guide surfaces are arranged at the upper parts of the hasp heads, when the first and the second protective covers are buckled with each other, the hasp plates are subject to outward radial elastic deformation after the guide surfaces of the hasp heads are propped against the end surfaces of the retaining rings, and the hasp heads start to cross the end surfaces of the retaining rings; and the hasp plates rebound under the action of an elastic restoring force after the hasp heads cross the retaining rings, and the hasp heads are clamped with the retaining rings, so that the fixed connection between the protective covers is completed.

6. The fitness equipment, according to claim 5, wherein concave parts, which correspond in position to the hasp plates, are formed on the inner surface of the ring-shaped gravity body, the hasp plates are matched in width and thickness with the concave parts, and the hasp plates are embedded into the concave parts after the first and the second protective covers are buckled with each other.

7. The fitness equipment, according to claim 1, wherein a protective sleeve made of rubber is in sleeved connection with the outer surface of the ring-shaped gravity body, and a decorative ring is in sleeved connection with the outer surface of the protective sleeve.

8. The fitness equipment, according to claim 1, wherein the outer surface of the handle is coated with an anti-skid layer made of rubber.

9. A fitness equipment comprising a ring-shaped gravity body and a handle connected with the gravity body, wherein:

the handle is positioned in the radial position of the interior of the ring-shaped gravity body, the end parts of the handle are detachably and fixedly connected with the gravity body, protective covers are embedded into the inner surface of the ring-shaped gravity body, and through the coverage of the protective covers, the connecting parts between the ring-shaped gravity body and the handle are rendered smooth; and the protective covers comprise a first protective cover and a second protective cover which are both ring-shaped, the inner ring surfaces of the protective covers are smooth, the outer ring surfaces of the protective covers are matched with the inner surface of the ring-shaped gravity body, the first protective cover and the second protective cover are butted from two sides along the axis of the ring-shaped gravity body, the first and the second protective covers are fixedly connected with each other through a butting connection mechanism and cover the inner surface of the ring-shaped gravity body, the first and the second protective covers are respectively provided with semi-circular enclosure parts which are matched with the handle in shape, have the same axial direction as the handle and are arranged in handle installation positions, convex ribs are arranged on the axial end surfaces of the enclosure parts and extend inwards in the radial direction of the handle, a ring-shaped groove which correspond to the convex ribs in position are correspondingly formed on the handle, the convex ribs are matched with the ring-shaped groove of the handle and are embedded into the groove, and after embedding, the enclosure parts enable the handle to be smoothly connected with the protective covers.

* * * * *